US010968091B2

(12) United States Patent
Krulitsch

(10) Patent No.: US 10,968,091 B2
(45) Date of Patent: Apr. 6, 2021

(54) FILLING ELEMENT AND FILLING MACHINE

(71) Applicant: KHS GmbH, Dortmund (DE)

(72) Inventor: Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 364 days.

(21) Appl. No.: 14/418,597

(22) PCT Filed: Jul. 13, 2013

(86) PCT No.: PCT/EP2013/002088
§ 371 (c)(1),
(2) Date: Jan. 30, 2015

(87) PCT Pub. No.: WO2014/019642
PCT Pub. Date: Feb. 6, 2014

(65) Prior Publication Data

US 2015/0191338 A1 Jul. 9, 2015

(30) Foreign Application Priority Data

Jul. 30, 2012 (DE) ..... 10 2012 014 957.3

(51) Int. Cl.

| | |
|---|---|
| ***B67C 3/26*** | (2006.01) |
| ***B67C 3/06*** | (2006.01) |
| ***B65B 39/00*** | (2006.01) |
| ***B65B 39/04*** | (2006.01) |
| ***B65B 31/04*** | (2006.01) |

(Continued)

(52) U.S. Cl.
CPC ..... *B67C 3/26* (2013.01); *B65B 31/044* (2013.01); *B65B 39/001* (2013.01); *B65B 39/04* (2013.01); *B67C 3/06* (2013.01); *B67C 3/24* (2013.01); *B67C 3/2614* (2013.01); *B65B 3/04* (2013.01); *B65B 2210/08* (2013.01); *B67C 2003/2657* (2013.01)

(58) Field of Classification Search
CPC ... B65B 39/001; B65B 39/04; B65B 2210/08; B65B 31/044; B65B 3/04; B67C 3/02; B67C 3/06; B67C 3/045; B67C 3/24; B67C 3/26; B67C 2003/2657
USPC ..... 141/82, 146, 148, 198, 275, 302, 392
See application file for complete search history.

(56) References Cited

U.S. PATENT DOCUMENTS 2,716,517 A * 8/1955 Tollberg ..... B67C 3/16 141/117
2,839,093 A * 6/1958 McCarthy ..... B65B 31/02 141/275

(Continued)

FOREIGN PATENT DOCUMENTS

DE 19 07 283 4/1970
DE 1907283 A1 * 4/1970 ..... B67C 3/222

(Continued)

*Primary Examiner* — Andrew D StClair
(74) *Attorney, Agent, or Firm* — Occhiuti & Rohlicek LLP

(57) ABSTRACT

In a container-filling machine, a filling element includes a housing, a sealing tulip, and a bellows. The housing has a housing section and an orifice. The sealing tulip moves relative to the housing section along an axis between a raised and a lowered position. The bellows surrounds the axis. The bellows' two ends connect tightly to the housing and the tulip respectively. As a result, the bellows seals a transition between the tulip and the housing.

21 Claims, 2 Drawing Sheets

(51) Int. Cl.
*B67C 3/24* (2006.01)
*B65B 3/04* (2006.01)

(56) References Cited

U.S. PATENT DOCUMENTS 3,530,928 A * 9/1970 Swinney ..... B22C 15/245 141/148
3,799,222 A * 3/1974 Franz ..... B67C 3/16 141/291
3,807,463 A * 4/1974 Rademacher ..... B67C 3/06 141/104
3,834,428 A * 9/1974 Rademacher ..... B67C 3/2628 141/39
3,845,791 A 11/1974 Friendship
3,892,264 A * 7/1975 Held ..... B67C 3/04 141/114
4,434,821 A * 3/1984 Bacroix ..... B67C 3/2634 141/301
4,648,421 A * 3/1987 Chant ..... B65B 39/004 137/312
4,804,114 A * 2/1989 Rizzardi ..... B67C 3/002 137/240
5,040,574 A * 8/1991 Petri ..... B67C 3/06 141/147
5,145,008 A * 9/1992 Yun ..... B67C 3/06 141/147
5,474,113 A * 12/1995 Rademacher ..... B67C 3/2608 141/116
2010/0313959 A1* 12/2010 Termansen ..... B65B 39/004 137/1
2011/0287126 A1* 11/2011 Geltinger ..... B29C 49/12 425/522

FOREIGN PATENT DOCUMENTS

DE 22 02 292 7/1973
DE 37 13 015 10/1988
DE 2005067709 3/2005
DE 2006298382 11/2006
DE 2010042832 2/2010
DE 10 2008 057752 5/2010
DE 102008057752 5/2010
DE 102008057752 A1 * 5/2010 ..... B67C 3/045

* cited by examiner

FILLING ELEMENT AND FILLING MACHINE

RELATED APPLICATIONS

This application is the national stage, under 35 USC 371, of PCT application PCT/EP2013/002088, filed on Jul. 13, 2013, which claims the benefit of the Jul. 30, 2012 priority date of German application DE 10 2012 014 957.3, the content of which is herein incorporated by reference.

FIELD OF INVENTION

The invention relates to a filling element for filling systems or filling machines for filling containers, such as cans.

BACKGROUND

A variety of filling machines for filling containers are known. These container include cans. These cans are usually filled with a liquid filling material, such as beer, or soft drinks. These filling machines include, in particular, pressure-filling machines, in which there is a sealed contact between a filling element and the can.

In typical machines, a sealing tulip causes the sealed contact between the filling element and a container. This is achieved by lowering the sealing tulip against the container to form a seal against an edge of the container's orifice. This creates a space that encloses the container orifice and the delivery orifice of the filling element. This space is sealed off from the exterior.

A sealing tulip is formed by an annular body that is disposed on a section of the filling element housing so as to be displaceable along a direction parallel to a filling element axis between a raised position and the lowered position. A seal encircles the filling element axis between the annular body of the sealing tulip and the outer face of the housing section so as to seal off the transition between the annular body and the filling element housing. Because the tulip is constantly moving up and down, this seal is a sliding seal.

While the filling machine is in operation, the sliding seal, like most moving parts, must constantly be lubricated to minimize wear. The lubricant is typically water.

A difficulty that arises with sliding seals is that it is difficult to prevent this lubricating water from also dripping into the containers being filled. Inevitably, bacteria and dirt particles manage to get past the sliding seal. This lubricating water can thus carry bacteria and dirt into the drink. Not surprisingly, consumers tend to regard the introduction of seal-lubricating water into their drink as rather undesirable.

SUMMARY

An object of the invention is to provide a filling element that avoids having a sliding seal between the sealing tulip and the filling element housing, thus eliminating the disadvantages that are associated with a sliding seal.

In one aspect, the invention features an apparatus for filling containers with liquid filling material. Such an apparatus includes a filling element with a filling-element housing, a sealing tulip, and a bellows. The housing includes a first housing section and a delivery orifice for controlled delivery of the liquid filling material into a container. The sealing tulip is movable relative to the housing section along a filling element axis between raised and lowered positions. In the lowered position, the sealing tulip is sealed against an orifice edge of the container. Meanwhile, the bellows surrounds the filling element axis. A first end of the bellows connects tightly to the filling element housing, and a second end of the bellows connects tightly to the sealing tulip. The bellows thus seal a transition between the sealing tulip and the filling element housing.

In some embodiments, the housing section includes an enveloping face. In these embodiments, the sealing tulip and the bellows surround the housing section on the enveloping face. This forms an annular gap between the enveloping face and an inner face of both the sealing tulip and the bellows. Among these embodiments are those in which the channel opens out into the annular gap thus formed. In some of these embodiments, the channel includes an opening that leads into the annular gap. The channel thus defines a channel axis oriented in a direction such that an angle between the channel axis and a notional plane that is perpendicular to the filling element axis is less than ninety degrees. In at least some cases, the channel axis is also arranged in a plane parallel to the filling element axis.

In other embodiments, the housing section includes a cylindrical enveloping face. Some of these embodiments also have a channel that opens out into an annular gap formed between the enveloping face and the bellows and sealing tulip at an end of the annular gap that lies away from the sealing tulip.

In additional embodiments, which include a clamping ring, the housing also includes a second housing section and a step that connects it to the first housing section. This second housing section has a larger outer cross-section than the first housing section, hence the need for the connecting step. The connection is at an end that lies furthest from the delivery orifice. The clamping ring holds the bellows in a region of the step by clamping it against the filling element housing.

In additional embodiments, the sealing tulip includes an annular body having inner and outer faces. A lower bellows section extends from the second end of the bellows away from the delivery orifice, while an upper bellows section is disposed between the lower bellows section and the first end of the bellows. The lower bellows section surrounds the filling element axis and extends from the upper bellows section into the annular body, where it is tightly connected to the inner face of the annular body. In some of these embodiments, the inner face of the annular body includes walls forming a recess, and the lower bellows section is tightly connected to the inner face at this recess.

Some embodiments also include a filling machine having a rotor that rotates about a vertical machine axis. The rotor defines a plurality of filling positions for filling cans or other containers. In these embodiments, the filling element is one of many other identical filling elements disposed around the rotor at each filling position.

In one aspect, the invention features a filling element that includes a housing, a sealing tulip, and a bellows. The housing has a housing section and an orifice. The sealing tulip moves relative to the housing section along an axis between a raised and a lowered position. The bellows surrounds the axis. The bellows' two ends connect tightly to the housing and the tulip respectively. As a result, the bellows seals a transition between the tulip and the housing.

The sealing tulip is also preferably configured as or acts as a centering tulip. In some embodiments, a cam follower effects the lifting motion of the tulip along the filling element axis between a raised starting position and a lowered working position. In these embodiments, the cam follower exerts contact pressure when the sealing tulip lies against an orifice edge of a container during filling. This contact pressure can assist pressure resulting from pre-tensioning and/or filling pressure.

The pressing force generated by the pre-tensioning and filling pressure is determined, in essence, by the effective diameter of the bellows, taking into account the effective orifice cross-section of the container. The effective orifice cross-section corresponds to the portion not covered by the sealing tulip. The magnitude of this pressing force can be set by an appropriate choice of the effective diameter of the bellows. By altering the pre-tensioning and/or filling pressure, the component of the pressing force that results from that pressure can also be set and/or regulated and adapted to the particular container, in particular to its strength.

In a preferred embodiment of the invention, there opens out into the annular gap that is formed between the bellows and the sealing tulip and that section of the filling element housing that is enclosed by these elements, at least one channel that, during a CIP cleaning and/or CIP sterilization of the filling system, is used to supply or expel a liquid cleaning and/or sterilization medium into or out of the annular gap. The channel opens out into this annular gap preferably at an upper end thereof, and preferably in a region of local attachment of the bellows.

The channel opens out into the annular gap preferably at an angle and in such a way that the cleaning and/or disinfection medium leaving the channel flows through the annular gap from top to bottom in a spiral stream that, because of its high flow velocity and spiral course, optimally cleans and/or disinfects all the interior faces of the bellows, and in particular the surfaces inside the folds of the bellows.

The inventive filling element is designed in particular for the pressure filling of cans or similar containers, and especially for pressurized filling with a high throughput.

As used herein, "pressure-filling" means a filling method in which the container to be filled lies sealed against the filling element and in which, usually before the actual filling phase, i.e., before the liquid valve is opened, the container has been pre-tensioned through at least one controlled gas path configured in the filling element with a pressurized pre-tensioning gas, such as an inert gas, which is typically $CO_2$ gas, which the filling material entering the container during filling increasingly displaces as a return gas out of the container interior, through at least one controlled gas path configured in the filling element. This pre-tensioning phase can be preceded by other treatment phases, such as an evacuation of the container interior and/or a washing of the container interior with an inert gas such as $CO_2$, through the gas paths configured in the filling element.

As used herein, a container is in "a sealed position against the filling element" when the container that is to be filled lies with its container mouth pressed tightly against the filling element or against a sealing tulip.

For the purpose of the invention the expressions "essentially", "in essence" or "around" all mean variations from the respective exact value by ±10%, preferably by ±5% and/or variations in the form of changes insignificant for the function.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

The invention is explained in detail below through the use of an exemplary embodiment with reference to the figures.

DETAILED DESCRIPTION

Figure 1:
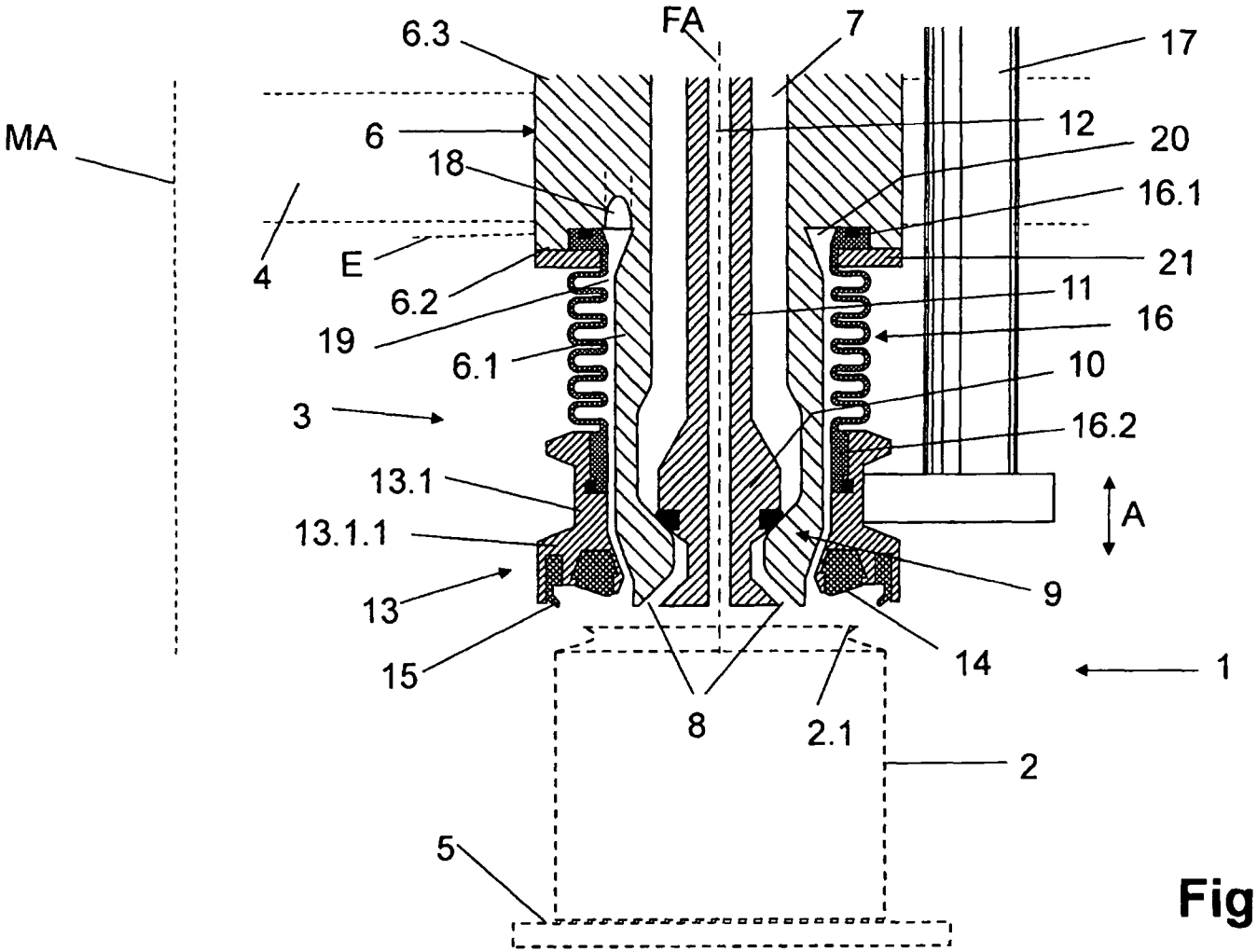
FIG. 1 shows a simplified view and partial section of a filling element according to the invention, together with a container that is to be filled.

FIG. 1 shows a filling position 1 of a filling machine for the pressure-filling of containers 2, such as cans with a liquid filling material, for example with a carbonated filling material, such as beer or soda pop. The filling position 1 has a filling element 3 that, together with a plurality of identical filling elements, is disposed on a periphery of a rotor 4 that is driven to rotate about a vertical machine axis. Under each filling element 3 is a platform 5 that is coupled to the rotor 4. A container 2 to be filled stands upright, on its base, on this platform 5.

Each filling element 3 includes a filling element housing 6 in which is configured a liquid channel 7 for the filling material. At its upper region, which is not depicted in the figure, the liquid channel 7 connects to a reservoir provided on the rotor 4. This reservoir supplies filling material for all filling elements 3 together. At its lower end, the filling element housing 6 forms an annular delivery orifice 8 for the filling material.

Upstream of the delivery orifice 8, in the direction of flow of the filling material, is a liquid valve 9. The liquid valve 9 has a valve body 10 that is configured in the region of a lower end of a gas tube 11. The gas tube 11 is arranged along a filling-element axis FA that is oriented parallel to a machine axis MA. A gas channel 12, which is open on the underside of the filling element 3, is formed in the gas tube 11.

The valve body 10 interacts with a valve seat in the liquid channel 7 and acts as a valve cam follower. An actuating device, not shown, causes the gas tube 11 to raise the valve body 10 from its closing position, as shown in FIG. 1, to open the liquid valve 9 and to then lower it again to close the liquid valve 9.

In its lower region, the filling-element housing 6 forms a tube-like housing section 6.1 with a reduced diameter. A sealing tulip 13, which is able to move parallel to the filling element axis FA along the double arrow A, is provided on the tube-like housing section 6.1, along with the delivery orifice 8 and the valve seat for the liquid valve 9. The sealing tulip 13 has an annular body 13.1 that surrounds the tube-like housing section 6.1. A distal portion of the annular body 13.1 transitions into a lower annular body section 13.1.1 that has an enlarged outer diameter. The lower annular body section 13.1.1 has an inner ring seal 14 and an outer lip seal 15. The inner ring seal 14 concentrically surrounds the filling element axis FA. The outer lip seal 15 concentrically surrounds the inner ring seal 14 and the filling element axis FA.

Bellows 16 seal the transition between the sealing tulip 13 or the annular body 13.1 and the filling element housing 6. The bellows 16 have an upper edge, which lies further away from the delivery orifice 8, and a lower edge, which lies closer to the delivery orifice 8.

The bellows 16 encircle the tube-like housing section 6.1 above the sealing tulip 13. An upper edge of the bellows 16 connects to the filling element housing 6. A lower edge of the bellows 16 connects to the top of the sealing tulip 13, which is the portion of the sealing tulip 13 that is furthest from faces away from the inner ring seal 14 and the outer lip seal 15. The bellows 16 are made from a suitable elastic and/or flexible material, for example TEFLON®. As FIG. 1 also shows, both the sealing tulip 13 and the bellows 16 surround the tube-like housing section 6.1 at a distance. This creates an annular gap 19 between the tube-like housing section 6.1, the bellows 16, and the sealing tulip 13.

A channel 18 opens out into an upper region of the annular gap 19. During CIP cleaning of the filling machine and its filling elements 3, this channel 18 is used to feed a liquid cleaning and/or sterilization medium into the annular gap 19. The liquid cleaning and/or sterilization medium then flows through this annular gap 19 over the entire axial length, cleaning and/or sterilizing the interior faces of the bellows 16 as it does so.

Figure 2:
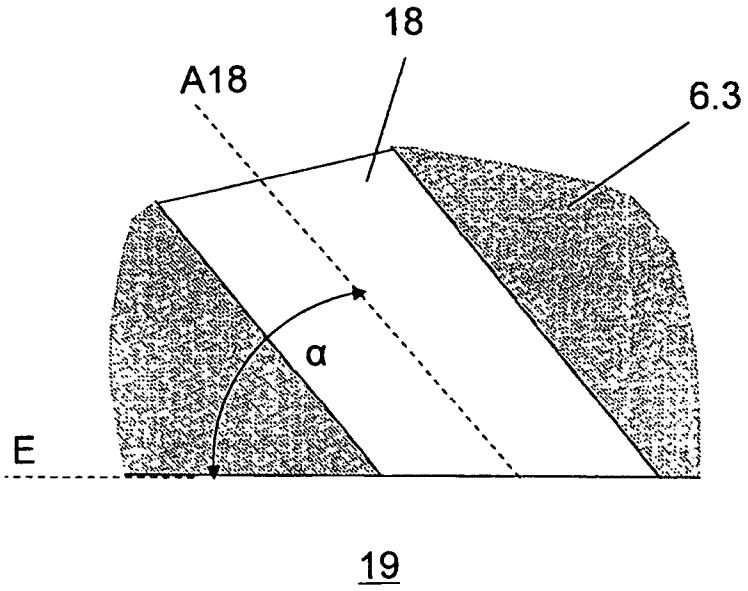
FIG. 2 shows a simplified schematic view of a section through a filling element housing in the region of a channel or of a bore for supplying or expelling a CIP cleaning and/or sterilization medium.

As shown in FIG. 2, the channel 18 is configured so as to open out into the annular gap 19 obliquely, i.e. at an angle $\alpha$ of less than 90° relative to a plane E that is perpendicular to the filling element axis FA. During CIP cleaning and/or disinfection, this angle imparts, to the medium that flows out of the channel 18, a velocity vector having a component in a peripheral direction of the outer face of tube-like housing section 6.1 or about the filling element axis FA. As a consequence of this velocity vector, the medium flows through the annular gap 19 from top to bottom in a spiral path. The combination of an adequately high flow velocity of the CIP cleaning and/or disinfection medium flowing along a spiral path thoroughly and optimally cleans and disinfects all interior faces, including those of the bellows 16. The channel 18 can also be used to wash and/or pre-tension a container that is already present in the sealed position at the filling position.

Adjoining the tube-like housing section 6.1 via a step 6.2 is an enlarged housing-section 6.3. This enlarged housing-section 6.3 has an outer diameter that is larger than that of the tube-like housing section 6.1. In order to attach the upper end of the bellows 16, which is the end that lies furthest away from delivery orifice 8, the bellows 16 are manufactured at that end in a single piece that incorporates a first annular bellows section 16.1.

An annular recess 20 formed on the step 6.2 accommodates the first annular bellows section 16.1. A clamping ring 21 that encircles the filling element axis FA clamps the first annular bellows section 16.1 to this annular recess 20. At its lower end, which lies nearest to the delivery orifice 8, the bellows 16 have an integral second annular bellows section 16.2 that extends into the annular body 13.1. The second annular bellows section 16.2 connects to a recess on the inner face of the annular body 13.1. This connection is established in any of a variety of ways including, without limitation, gluing, clipping, clamping, vulcanizing, and screwing. Regardless of how it is made, the connection results in the inner face of the second bellows section 16.2 being flush or essentially flush with the contiguous inner face of annular body 13.1.

In order to fill a container 2 that is arranged with its container orifice beneath the filling element 3, the sealing tulip 13 is first lowered along the filling element axis FA down onto the container 2 so that the inner ring seal 14 lies sealed against a container edge or an orifice edge 2.1 that surrounds the container's orifice. This centers the container 2 and places it in a sealed position on the filling element 3. The controlled lowering of the sealing tulip 13 is effected, for example, in a cam-controlled manner by a cam follower 17.

The outer lip seal 15 is used, in the case of CIP cleaning for example, to seal a washing cap that is required for this purpose.

Prior to the actual filling, the container 2, which is in a sealed position on the filling element 3, is pre-tensioned via the gas channel 12 using a pressurized inert gas, such as pressurized $CO_2$ gas. After pre-tensioning, the actual filling phase is initiated by opening the liquid valve 9. As it flows into the container, the filling material displaces the inert gas out of container 2 through the gas channel 12.

The pre-tensioning and/or filling pressure acting on the inner annular surfaces of the sealing tulip 13 and of bellows 16 produces, for the sealing tulip 13, a pressing force that cooperates with a pressing force exerted by the cam follower 17 to press the sealing tulip 13, or its inner ring seal 14, against the orifice edge 2.1. The pressing force with which the sealing tulip 13, or its inner ring seal 14, lies against the orifice edge 2.1 can therefore be set by the pre-tensioning and/or filling pressure.

The effective diameter of the bellows 16 that is relevant for the pressing force resulting from the pre-tensioning and/or filling pressure is dependent on the inner bellows diameter $d_i$ and the larger outer bellows diameter $d_a$ and corresponds to the root of $(d_i^2+d_a^2)/2)$.

The previously customary guideway for the sealing tulip 13 on the tube-like housing section 6.1, with a sliding seal, and its resulting disadvantages, are thus by configuring the filling element 3 with bellows 16.

With an existing filling machine which is already conceived for the use of conventional filling elements, and particularly when filling elements 3 are to be used instead of those conventional filling elements, it is expedient to set the effective diameter of the bellows 16 by an appropriate choice of the inner and outer bellows diameter $d_i$ and $d_a$ respectively in such a way that this effective diameter matches the slide diameter of the sliding seal that is used in conventional filling elements.

The invention has been described hereinbefore by reference to one embodiment. Numerous variations as well as modifications are possible without departing from the inventive concept underlying the invention.

Having described the invention, and a preferred embodiment thereof, what is claimed as new, and secured by Letters Patent is:

1. An apparatus comprising a can-filling machine for filling cans with liquid filling-material, said can-filling machine comprising a rotor that rotates about a vertical machine-axis and that defines filling positions for filling cans, a filling element disposed in one of said filling positions, said filling element comprising a filling-element housing comprising a first housing-section that defines a liquid channel that extends along a filling-element axis and through said first housing-section to a delivery orifice through which a controlled flow of liquid filling-material enters a can, a sealing tulip that is movable along said filling-element axis between a raised position, at which said sealing tulip releases said can, and a lowered position, at which said sealing tulip seals against an orifice edge of said can, a bellows that surrounds said filling-element axis and at least a portion of said filling-element housing and that forms seals with said filling-element housing and said sealing tulip at first and second ends thereof, wherein said bellows seals a transition between said sealing tulip and said filling-element housing, whereby there is no sliding seal to seal said transition between said tulip and said filling-element housing, and a valve disposed in said liquid channel and configured to control flow of said liquid filling-material through said delivery orifice, wherein, during operation of said filling element, either a filling pressure or a pre-tensioning pressure acts on inner surfaces of both said sealing tulip and said bellows and also presses said sealing tulip against said orifice edge, wherein said first housing-section, said tulip, and said bellows cooperate to define an annular gap that extends from a proximal end of said first housing-section to a distal end of said first housing-section, said annular gap having an inner wall formed by an outer surface of said first housing-section and an outer wall having a proximal section formed by an inner face of said bellows and a distal section formed by an inner surface of said sealing tulip, wherein said can-filling machine further comprises a channel, wherein said channel opens out into said annular gap at a location selected such that liquid cleaning medium that enters through said channel cleans an inner face of said bellows, wherein said channel comprises an opening that leads into said upper annular gap, wherein said channel defines a channel axis, wherein said channel axis forms an angle relative to a plane that is perpendicular to said filling element axis, and wherein said angle is less than ninety degrees.

2. The apparatus of claim 1, wherein said channel is configured so as to open out into said annular gap at an angle relative to a plane that is perpendicular to said filling element axis such that, during CIP cleaning and/or disinfection, said angle imparts, to a medium that flows out of said channel, a velocity vector having a component in a peripheral direction of the outer face of said first housing section, whereby said medium flows through said annular gap from top to bottom in a spiral path for cleaning all interior faces of said annular gap, including said bellows.

3. The apparatus of claim 1, wherein said sealing tulip comprises an annular body that surrounds said first housing section, wherein said annular body comprises a proximal portion and a distal portion, said distal portion comprising a lower annular body section having an enlarged outer diameter that is greater than an outer diameter of said proximal portion, and wherein said lower annular body section comprises an inner ring seal and an outer lip seal.

4. The apparatus of claim 1, wherein said sealing tulip comprises an annular body, wherein said annular body has an inner face and an outer face, wherein said bellows comprises a lower bellows section that extends from said second end of said bellows away from said delivery orifice and an upper bellows section that is disposed between said lower bellows section and said first end of said bellows, wherein said lower bellows section is a cylinder that surrounds said filling element axis and extends distally from said upper bellows section into said sealing tulip's annular body, and wherein said lower bellows section connects to said inner face of said annular body.

5. An apparatus comprising a can-filling machine for filling cans with liquid filling-material, said can-filling machine comprising a rotor that rotates about a vertical machine-axis and that defines filling positions for filling cans, a filling element disposed in one of said filling positions, said filling element comprising a filling-element housing comprising a first housing-section that defines a liquid channel that extends along a filling-element axis and through said first housing-section to a delivery orifice through which a controlled flow of liquid filling-material enters a can, a sealing tulip that is movable along said filling-element axis between a raised position, at which said sealing tulip releases said can, and a lowered position, at which said sealing tulip seals against an orifice edge of said can, a bellows that surrounds said filling-element axis and at least a portion of said filling-element housing and that forms seals with said filling-element housing and said sealing tulip at first and second ends thereof, wherein said bellows seals a transition between said sealing tulip and said filling-element housing, whereby there is no sliding seal to seal said transition between said tulip and said filling-element housing, and a valve disposed in said liquid channel and configured to control flow of said liquid filling-material through said delivery orifice, wherein, during operation of said filling element, either a filling pressure or a pre-tensioning pressure acts on inner surfaces of both said sealing tulip and said bellows and also presses said sealing tulip against said orifice edge, wherein said first housing-section, said tulip, and said bellows cooperate to define an annular gap that extends from a proximal end of said first housing-section to a distal end of said first housing-section, said annular gap having an inner wall formed by an outer surface of said first housing-section and an outer wall having a proximal section formed by an inner face of said bellows and a distal section formed by an inner surface of said sealing tulip, wherein said can-filling machine further comprises a channel that opens out into said annular gap at said proximal end of said first housing-section.

6. The apparatus of claim 5, wherein said channel opens out into said annular gap at a location selected such that liquid cleaning medium that enters through said channel cleans an inner face of said bellows.

7. The apparatus of claim 5, wherein said sealing tulip comprises an annular body that surrounds said first housing section, wherein said annular body comprises a proximal portion and a distal portion, said distal portion comprising a lower annular body section having an enlarged outer diameter that is greater than an outer diameter of said proximal portion, wherein said lower annular body section comprises an inner ring seal and an outer lip seal.

8. The apparatus of claim 7, wherein said channel opens out into said annular gap, wherein said annular gap is formed between said first housing section and said bellows and sealing tulip, and wherein said channel opens at an end of said annular gap that lies away from said sealing tulip.

9. The apparatus of claim 5, further comprising a clamping ring, wherein said filling-element housing comprises a second housing-section that adjoins said first housing-section and a step that protrudes distally from said second housing-section, wherein said bellows extends between a proximal end and a distal end, said distal end being closer to said tulip than said proximal end, wherein said second housing-section has a larger outer cross-section than said first housing-section, wherein said clamping ring is configured cooperate with said step to form a radially-extending recess in which said clamping ring clamps said proximal end.

10. The apparatus of claim 5, wherein said sealing tulip comprises an annular body, wherein said annular body has an inner face and an outer face, wherein said bellows comprises a lower bellows section that extends from said second end of said bellows away from said delivery orifice and an upper bellows section that is disposed between said lower bellows section and said first end of said bellows, wherein said lower bellows section is a cylinder that surrounds said filling element axis and extends distally from said upper bellows section into said sealing tulip's annular body, and wherein said lower bellows section connects to said inner face of said annular body.

11. The apparatus of claim 10, wherein said inner face of said annular body comprises walls forming a distally-extending recess and wherein said lower bellows section connects to said inner face at said recess.

12. The apparatus of claim 5, wherein said first housing-section defines a valve seat for a valve body, said valve seat and said valve body together defining said valve.

13. The apparatus of claim 5, further comprising a cam follower that engages said sealing tulip, said cam follower being configured to be raised and lowered along an axis parallel to the filling-element axis and to raise and lower said tulip along said filling-element axis.

14. The apparatus of claim 5, wherein said annular gap opens at a distal end of said first housing-section.

15. The apparatus of claim 5, wherein said first housing-section is a tubular section that has a first housing-section diameter and that adjoins a second housing-section having a diameter greater than said first housing-section, and wherein said second housing-section engages said bellows.

16. The apparatus of claim 5, wherein said housing defines an annular liquid channel passing therethrough from a proximal end of said housing all the way to a distal end of said housing without interruption, wherein said filling element further comprises a gas channel extending through said liquid channel toward said orifice and opening on an underside of said filling element.

17. The apparatus of claim 5, wherein said valve comprises a valve body that seals against an inner wall of said first housing-section.

18. The apparatus of claim 17, further comprising a gas channel that opens on an underside of said filling element after having passed through said valve body, said gas channel being parallel to said filling-element axis.

19. The apparatus of claim 5, wherein said sealing tulip is under a second housing-section that adjoins said first housing-section, said first housing-section being surrounded by said tulip.

20. The apparatus of claim 5, wherein said bellows is elastic.

21. The apparatus of claim 5, wherein a distal end of said bellows is flush with an inner face of said sealing tulip.

* * * * *